US007497064B2

(12) United States Patent
Momich

(10) Patent No.: US 7,497,064 B2
(45) Date of Patent: Mar. 3, 2009

(54) VERTICAL CARTONER

(76) Inventor: Zoran Momich, 76 Bellechase Cir., Schaumburg, IL (US) 60173-6572

( * ) Notice: Subject to any disclaimer, the term of this patent is extended or adjusted under 35 U.S.C. 154(b) by 0 days.

(21) Appl. No.: 10/956,540

(22) Filed: Oct. 1, 2004

(65) Prior Publication Data

US 2006/0070352 A1 Apr. 6, 2006

(51) Int. Cl.
*B65B 1/08* (2006.01)

(52) U.S. Cl. ..... 53/247; 53/473; 53/235; 53/244; 53/250

(58) Field of Classification Search ..... 53/473, 53/474, 235, 244, 247, 250, 251, 437; 221/177, 221/178, 179, 183; 141/208, 223, 331
See application file for complete search history.

(56) References Cited

U.S. PATENT DOCUMENTS 2,225,336 A * 12/1940 Foster et al. ..... 141/270
2,364,902 A * 12/1944 Howard ..... 177/80
2,373,831 A * 4/1945 Howard ..... 177/80
2,610,726 A * 9/1952 Howard ..... 198/535
2,873,772 A * 2/1959 Joseph ..... 141/147
2,874,737 A * 2/1959 Magna et al. ..... 141/263
2,951,514 A * 9/1960 Flack ..... 141/132
3,107,793 A * 10/1963 Frank ..... 414/791
3,112,777 A 12/1963 Lohse
3,139,714 A * 7/1964 Hall ..... 53/540
3,219,132 A * 11/1965 Nowak, Jr. ..... 177/52
3,334,675 A * 8/1967 Toshihiko ..... 99/489
3,340,679 A * 9/1967 Johnson ..... 53/385.1
3,369,339 A 2/1968 Speiser
3,372,784 A * 3/1968 Ross et al. ..... 194/215
3,578,040 A * 5/1971 Galloway ..... 141/142
3,608,701 A 9/1971 Dieter
3,656,271 A 4/1972 O'Shea et al.
3,822,032 A * 7/1974 Vergobbi ..... 222/55
3,906,705 A 9/1975 Beck et al.
4,048,784 A 9/1977 Toby
4,203,274 A 5/1980 Warkentin et al.
4,211,054 A 7/1980 Sramek
4,314,785 A 2/1982 LaFleur et al.
4,330,252 A 5/1982 Bullock et al.
4,351,141 A * 9/1982 Glorfield et al. ..... 53/473
4,534,156 A * 8/1985 Smith ..... 53/503
4,538,693 A * 9/1985 Klopfenstein et al. .... 177/25.18
4,600,351 A 7/1986 Nelson
4,782,644 A 11/1988 Haarer et al.
4,804,550 A 2/1989 Bardsley et al.
4,817,779 A 4/1989 Beck et al.
4,856,566 A * 8/1989 Tisma ..... 141/142

(Continued)

FOREIGN PATENT DOCUMENTS

EP 0 765 810 A1 4/1997

(Continued)

*Primary Examiner*—Hemant M Desai
(74) *Attorney, Agent, or Firm*—Pauley Petersen & Erickson

(57) ABSTRACT

A system and method of vertically loading a product into a carton includes a bucket assembly and a funnel forming a lower portion of the bucket assembly. An open carton having a scoreline between a machine-side flap and the opening is positioned underneath the bucket assembly and a gate of the bucket assembly is moved from a closed position to an open position away from the scoreline of the carton.

6 Claims, 6 Drawing Sheets

U.S. PATENT DOCUMENTS

| | | | | | |
|---|---|---|---|---|---|
| 4,879,862 | A | | 11/1989 | Nolte et al. | |
| 4,982,556 | A | | 1/1991 | Tisma | |
| 5,022,216 | A | | 6/1991 | Muckenfuhs et al. | |
| 5,058,634 | A | * | 10/1991 | Tisma | 141/129 |
| 5,095,960 | A | | 3/1992 | Grundler et al. | |
| 5,144,790 | A | * | 9/1992 | Tisma | 53/251 |
| 5,159,796 | A | | 11/1992 | Tas | |
| 5,170,610 | A | | 12/1992 | Tisma | |
| 5,175,976 | A | | 1/1993 | Petry et al. | |
| 5,233,814 | A | | 8/1993 | Bergerioux et al. | |
| 5,388,389 | A | | 2/1995 | Tisma | |
| 5,417,261 | A | * | 5/1995 | Kanzler et al. | 141/313 |
| 5,457,941 | A | | 10/1995 | Long et al. | |
| 5,657,610 | A | | 8/1997 | Dietrich et al. | |
| 5,787,680 | A | | 8/1998 | Tisma et al. | |
| 6,126,375 | A | * | 10/2000 | O'Brien | 414/299 |
| 6,434,912 | B1 | | 8/2002 | Walz | |
| 6,729,103 | B1 | | 5/2004 | Hartness et al. | |
| 2002/0116905 | A1 | * | 8/2002 | Ikemoto et al. | 53/473 |

FOREIGN PATENT DOCUMENTS

| | | |
|---|---|---|
| IT | 296889 | 2/1972 |
| WO | WO 01/62601 | 8/2001 |

* cited by examiner

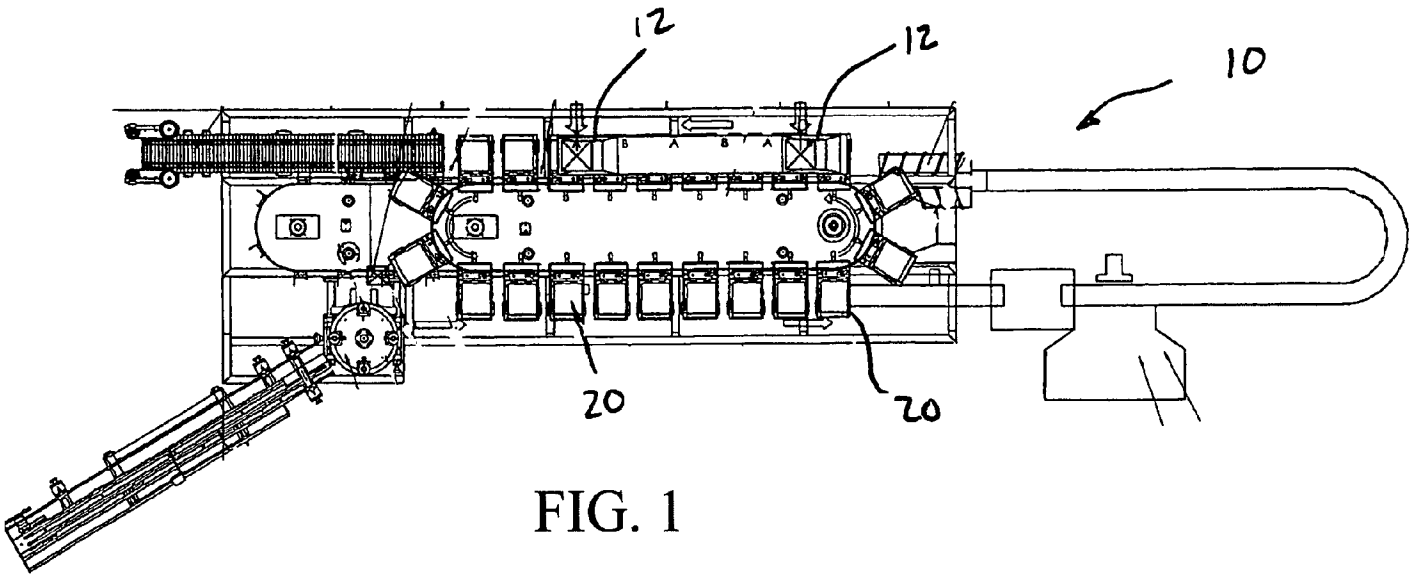
FIG. 1
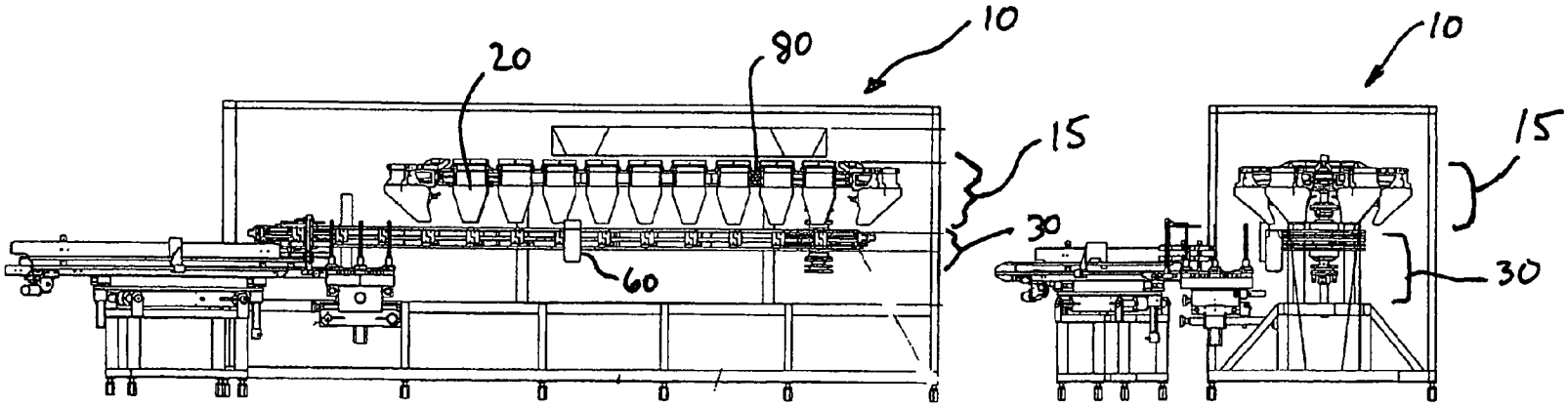
FIG. 3
FIG. 2

VERTICAL CARTONER

BACKGROUND OF THE INVENTION

1. Field of the Invention

This invention relates to a vertical cartoner having a gate that drops away from a scoreline of the carton.

2. Description of Related Art

Vertical cartoners are used in varied applications requiring the deposit of a product or, more typically, a number of products, such as food, pharmaceuticals and other items, into cartons or boxes. Vertical cartoners traditionally require: a carton chain to transport empty cartons for filling; a product loader for loading product into a bucket; a product chain for transporting product to the carton chain; and a gate for dropping the product from the product chain to the empty cartons on the carton chain. Traditional vertical cartoners drop a number of products from each bucket in the product chain through a gate that swings open and dumps the products, all at one time, into the carton.

Fill operations with traditional vertical cartoners involve swinging the gate instantly open toward a scoreline of the carton thereby resulting in a rush of product through the open gate. As a result, product may become clogged, damaged, may cause line stoppages or may result in partially filled and/or overfilled cartons when the gate is opened in this manner. As a result, such systems may require slower line speeds.

SUMMARY OF THE INVENTION

Accordingly, it is one object of this invention to provide a vertical cartoner that deposits product into a carton completely, quickly and accurately.

It is another object of this invention to provide a vertical cartoner that avoids clogged discharges, product damage, line stoppages and unfilled, misfilled and/or overfilled cartons.

These and other objects of this invention are addressed by a vertical cartoner that includes a product chain and a carton chain, a plurality of bucket assemblies and at least one product loader. According to a preferred embodiment of this invention, product is loaded into bucket assemblies of the product chain and conveyed into synchronization with the carton chain.

The cartons are preferably transported and positioned along carton chain so that each carton includes a vertically aligned opening. Each carton is positioned underneath a respective bucket assembly so that a scoreline of the carton is positioned between a machine-side flap and a vertically-aligned opening of the carton.

Each bucket assembly within the product chain preferably includes a tapered bottom portion or funnel forming a lower portion of the bucket assembly and a gate. The gate preferably accommodates the product within the bucket assembly prior to dumping product into the respective carton. The gate is preferably moveable between a closed position and an open position away from the scoreline of the carton.

A shaker or similar device preferably imparts a vibration to at least a portion of the vertical cartoner to effect a clean and complete transition of product from the bucket assembly to the respective carton without clumping or otherwise jamming product within the bucket assembly.

BRIEF DESCRIPTION OF THE DRAWINGS

These and other objects and features of this invention will be better understood from the following descriptions taken in conjunction with the drawings wherein:

FIG. 1 is a plan view of a vertical cartoner according to one preferred embodiment of this invention;

FIG. 2 is a side view of the vertical cartoner shown in FIG. 1;

FIG. 3 is a front view of the vertical cartoner shown in FIG. 1;

DETAILED DESCRIPTION OF THE PREFERRED EMBODIMENTS

Figure 4:
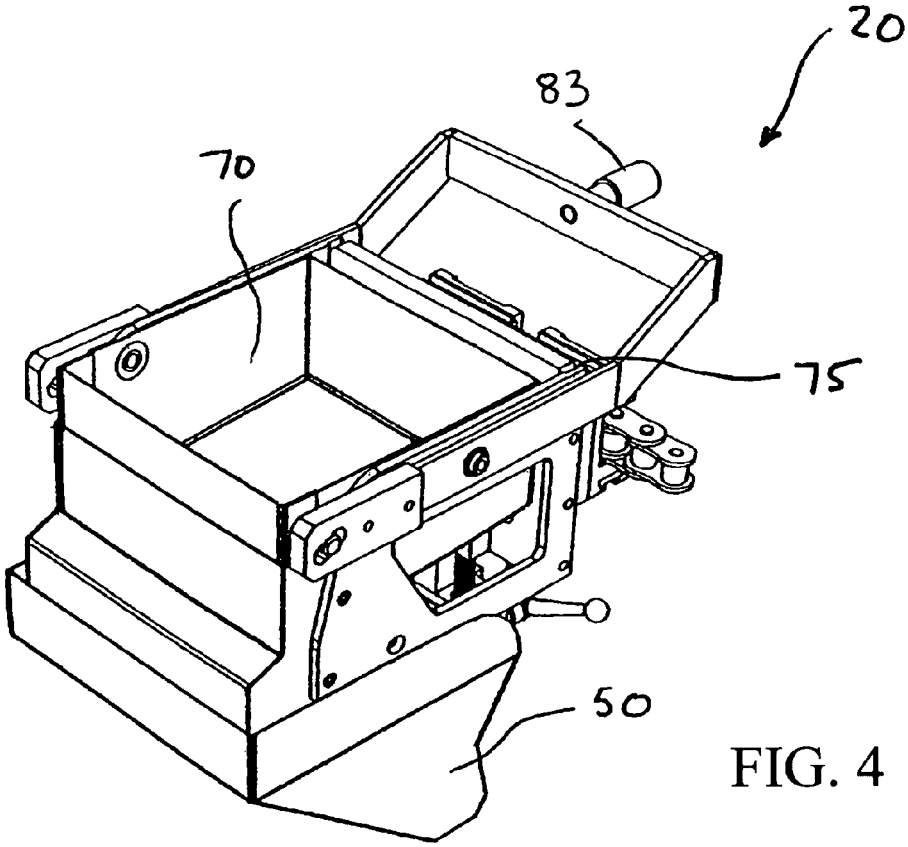
FIG. 4 is a side perspective view of a top view of a carrier chain according to one preferred embodiment of this invention.
Figure 5:
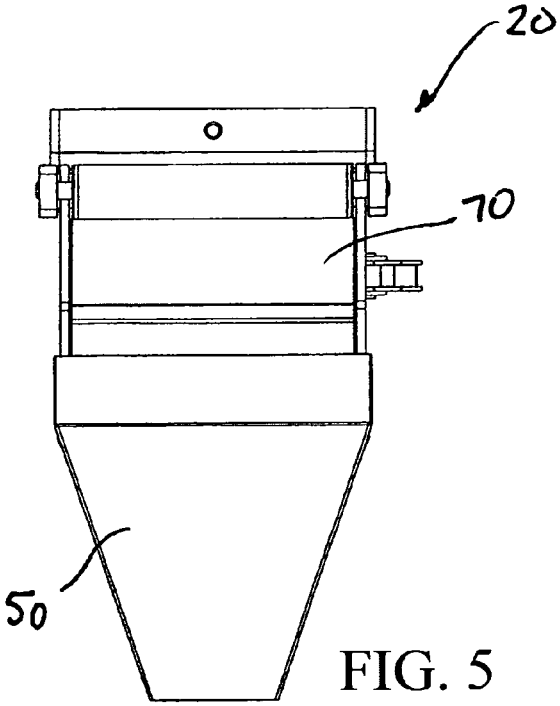
FIG. 5 is a front view of the bucket assembly shown in FIG. 4.
Figure 6:
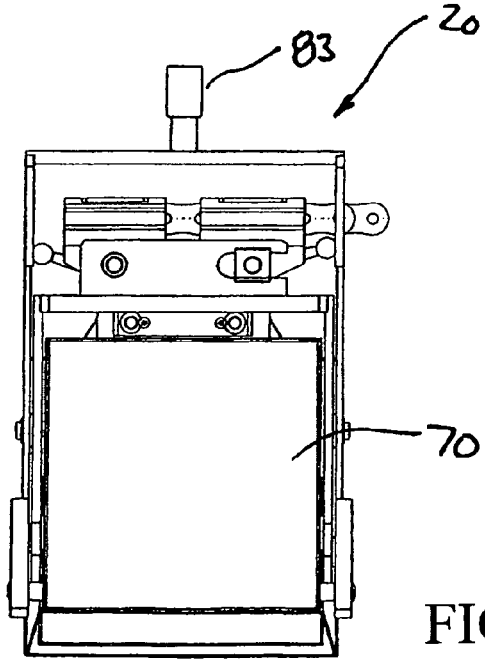
FIG. 6 is a top view of the bucket assembly shown in FIG. 4.

FIG. 1 shows a vertical cartoner 10 having product filler 12, product chain 15, a plurality of bucket assemblies 20 and carton chain 30. According to a preferred embodiment of this invention, product is loaded into bucket assemblies 20 of product chain 15 and conveyed into synchronization with carton chain 30. Product chain 15 and carton chain 30 both move in a machine direction of cartoner 10, which generally matches the path of product through cartoner 10. The filled cartons are then conveyed from the cartoner 10 for closure, palletizing, shipping, etc.

The term "product" as used herein may be one or more items, typically a collection of items, that are to be contained within a carton including food, beverages, pharmaceuticals, consumer goods, bulk goods, packages, papers and any other product that may be boxed or cartoned according to the method and apparatus described herein. Vertical cartoners such as disclosed herein are typically used to carton a collection of smaller product, such as sugar packets, candy, pasta and/or similar such goods that may be dumped, poured, released or otherwise transferred into carton 60 vertically disposed beneath bucket assembly 20.

The term "bucket assembly" is used to refer to the containment device in product chain 15 that transfers product from product filler 12 to carton chain 30 and/or into carton 60. The terms "bucket assembly" and "bucket" may be used interchangeably to refer to the assembly or unit that contains the product between product filler 12 and carton 60.

Products may be presented and transferred to product chain 15 in a number of ways known to those having ordinary skill in the art. As described above, products may include packets, individual or bulk food items, pharmaceuticals, bottles, bags, trays and any other product requiring cartoning. As such, equipment for presenting and transferring products to carton chain 30 need only be capable of placing, dropping, sliding or otherwise presenting product to each bucket assembly 20 along product chain 15.

Accordingly, carton chain 30 transporting a plurality of empty cartons 60 is preferably positioned adjacent product chain 15 as shown in FIG. 2. Carton chain 30 preferably includes a conveyor having a plurality of divisions or trays, each division receiving an empty and erect carton. The divisions in the carton chain 30 are preferably synchronized with bucket assemblies 20 in product chain 15. Such synchronization may either be mechanical, i.e., gearing, belts, etc., electrical, i.e., servomechanisms, etc., or a combination of both.

As shown in FIG. 1, vertical cartoner 10 may further include filler 12 for filling each bucket assembly 20 with a suitable amount of product. According to one preferred embodiment of this invention, vertical cartoner 10 includes two or more fillers 12 to fill alternating bucket assemblies 20 thereby increasing the speed at which the vertical cartoner 10 may operate. Preferably filler 12 meters a weight and/or other measurable characteristic of product and fills bucket assembly 20 with a predetermined amount and/or size of product.

According to a preferred embodiment of this invention, the described system for vertically loading product into carton 60 requires a plurality of bucket assemblies 20, each capable of transferring product from product filler 12 to carton 60. Cartons 60 are preferably positioned along carton chain 30 so that each carton 60 includes a vertically aligned opening. Each carton 60 is preferably positioned underneath a corresponding bucket assembly 20, carton 60 having a scoreline 65 between a machine-side flap and an opening.

Figure 9:
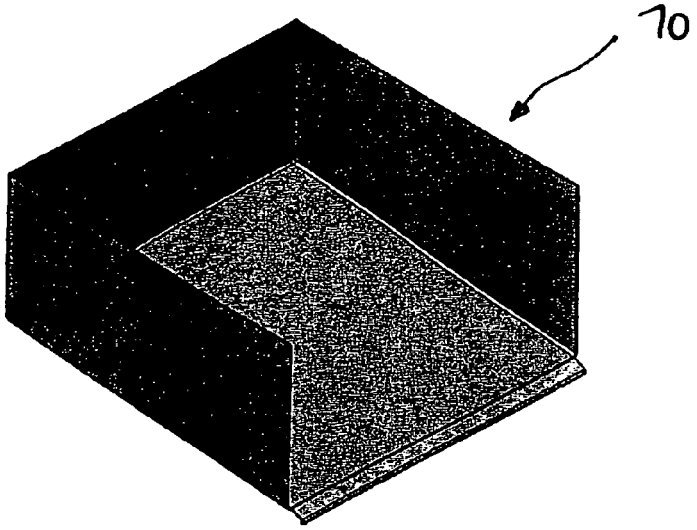
FIG. 9 is a front perspective view of a gate, for use in a bucket assembly, according to one preferred embodiment of this invention.

Each bucket assembly 20 within product chain 15 preferably includes a tapered bottom portion or, more specifically, funnel 50 forming a lower portion of bucket assembly 20 and gate 70 positioned within bucket assembly 20. According to one preferred embodiment of this invention, such as shown in FIG. 9, gate 70 preferably accommodates product within bucket assembly 70 prior to dumping product into carton 60. As such, gate 70 is preferably moveable between a closed position and an open position away from scoreline 65 of carton 60.

Figure 7:
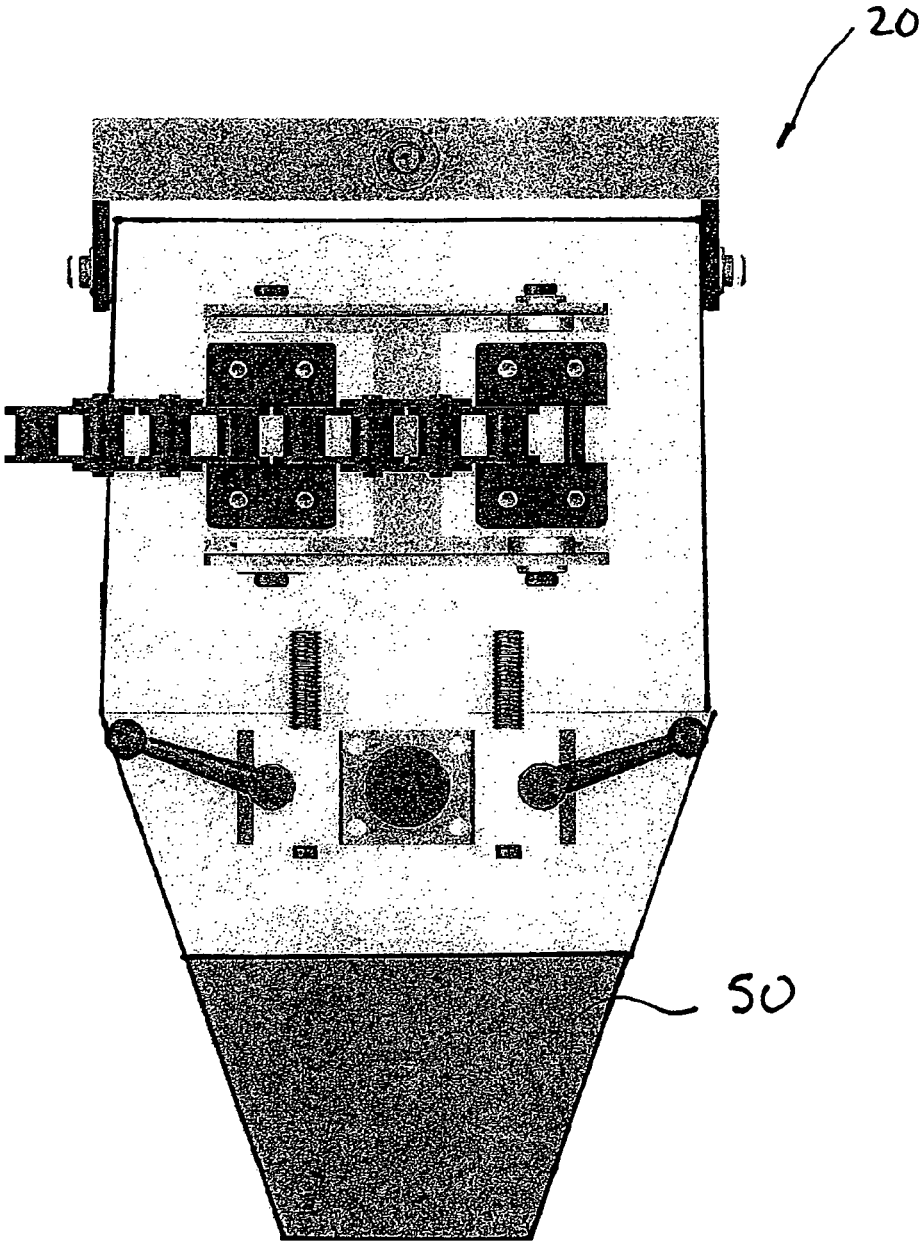
FIG. 7 is a back view of the bucket assembly shown in FIG. 4.
Figure 8:
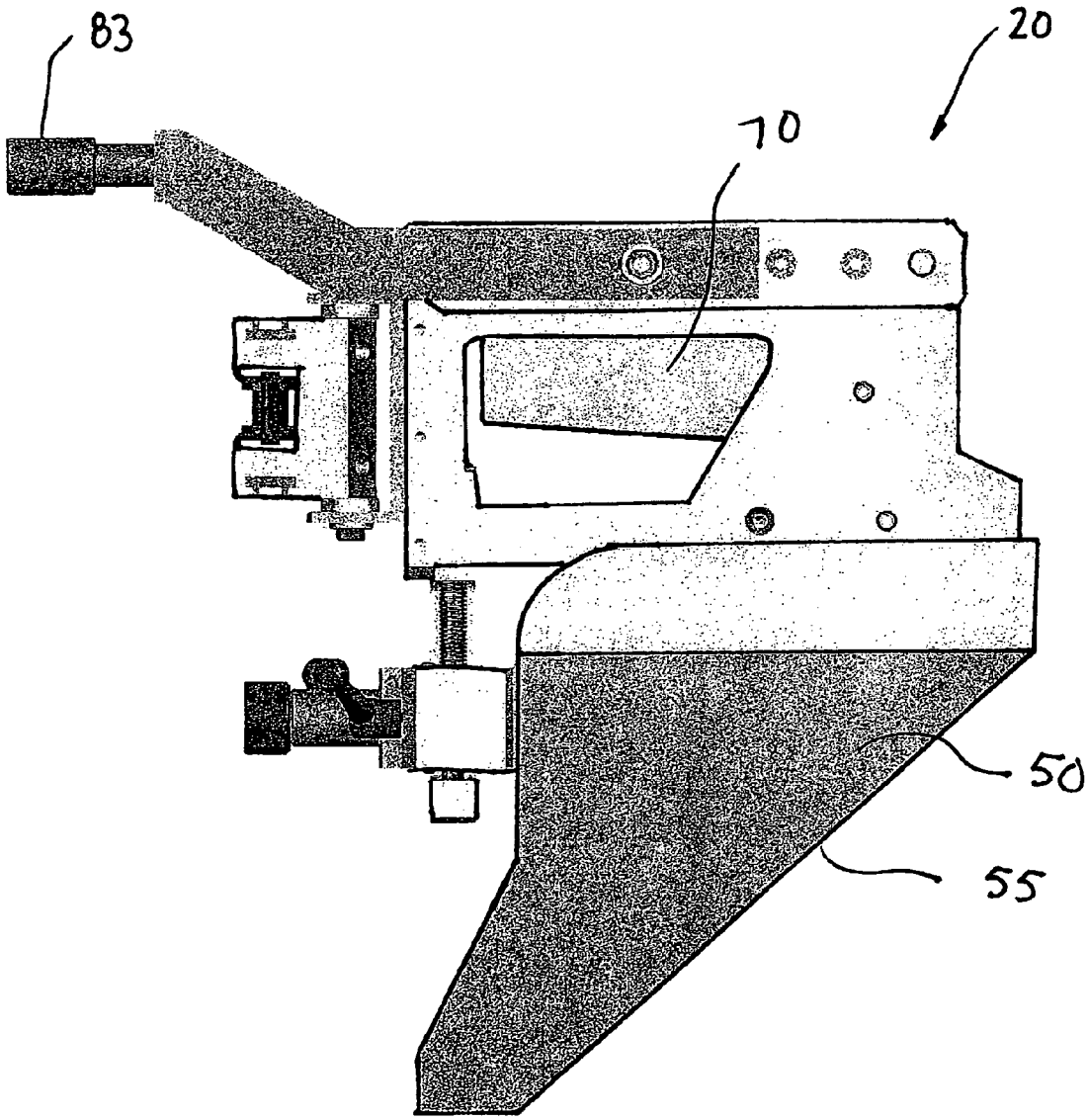
FIG. 8 is a side view of the bucket assembly shown in FIG. 4.
Figure 10:
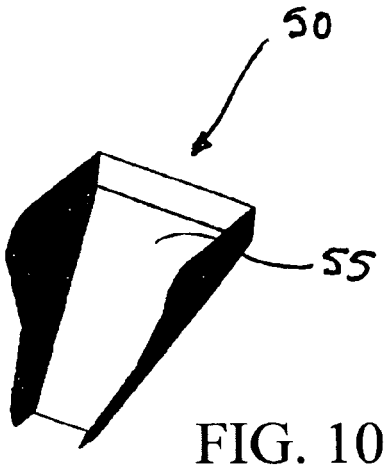
FIG. 10 is a front perspective view of a funnel, for use in a bucket assembly, according to one preferred embodiment of this invention.
Figure 11:
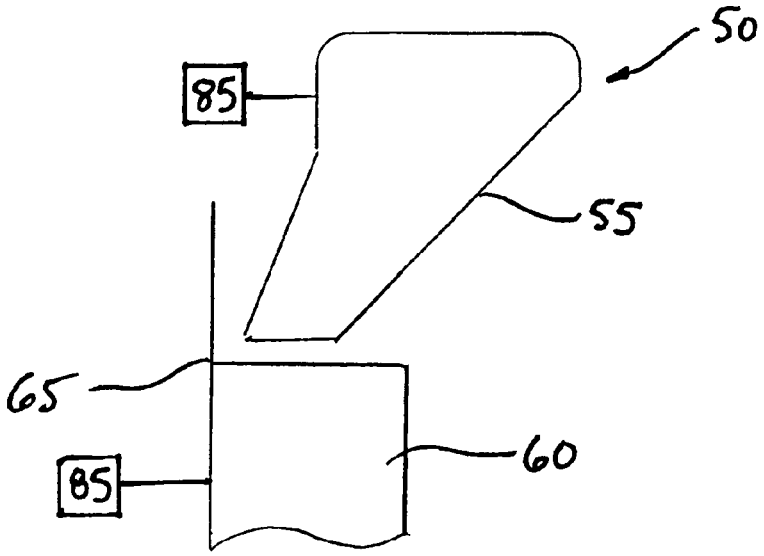
FIG. 11 is a view of a carton having a scoreline in relation to a funnel, according to one preferred embodiment of this invention.

As best shown in FIGS. 7, 8 and 10, funnel 50 preferably includes at least two angled opposing sidewalls 55. Each of the at least two sidewalls 55 are preferably positioned at an angle relative to vertical. Bucket assembly 20 may include gate 70 and funnel 50 having solid, uninterrupted sidewalls 55.

Gate 70 may further include hinge 75 positioned on gate 70. Hinge 75 is preferably positioned above the scoreline of carton 60 so that gate 70 opens away from scoreline 65 of carton 60.

According to one preferred embodiment of this invention, cam 80 may be positioned along product chain 15 relative to cam follower 83 and/or hinge 75 and/or gate 70 to control an opening speed of gate 70. Depending upon the product within bucket assembly 20, it may be advantageous to quickly or slowly open gate 70 to obtain the desired transfer of product into carton 60. Alternatively, or in addition, cam 80 and cam follower 83 may be used to dip bucket assembly 20 and specifically funnel 50 into carton 60 immediately prior to the filling operation.

Shaker 85 or similar device for imparting vibration to at least a portion of vertical cartoner 10 may be connected with respect to carton chain 30, product chain 15 and/or with the plurality of bucket assemblies 20. Shaker 85 preferably is used to effect a clean and complete transition of product from bucket assembly 20 to carton 60 without clumping or otherwise jamming product within bucket assembly 20.

In operation, vertical cartoner 10, such as described above, loads product into carton 60 from a plurality of bucket assemblies 20. Each bucket assembly 20 is loaded, preferably with filler 12, and then transported across product chain 15 synchronized with carton chain 30. When the respective bucket assembly 20 reaches a suitable position on carton chain 30 having an empty carton 60, gate 70 is opened away from scoreline 65 of carton 60.

As a result of, and immediately following opening of gate 70, product is streamed across gate 70 and along sidewall 55 of funnel 50 into carton 60. As described above, sidewall 55 of funnel 50 may be positioned above scoreline 65 at an angle relative to vertical to further urge product into carton 60 in a controlled, orderly manner. In addition, bucket assembly 20 and/or carton 60 may be vibrated to further urge the product into carton 60.

Figure 12:
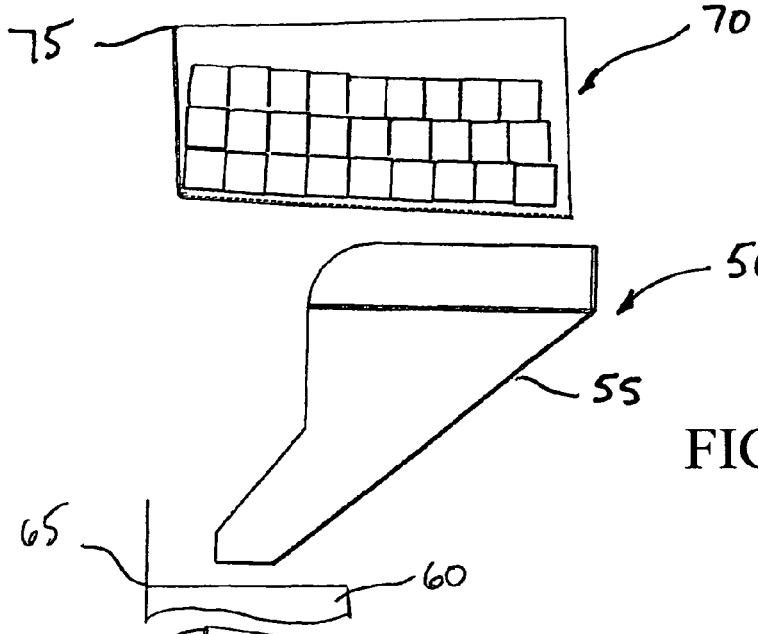
FIG. 12 is a side view of a portion of a bucket assembly, including a gate and a funnel, in an initial, loaded position.
Figure 13:
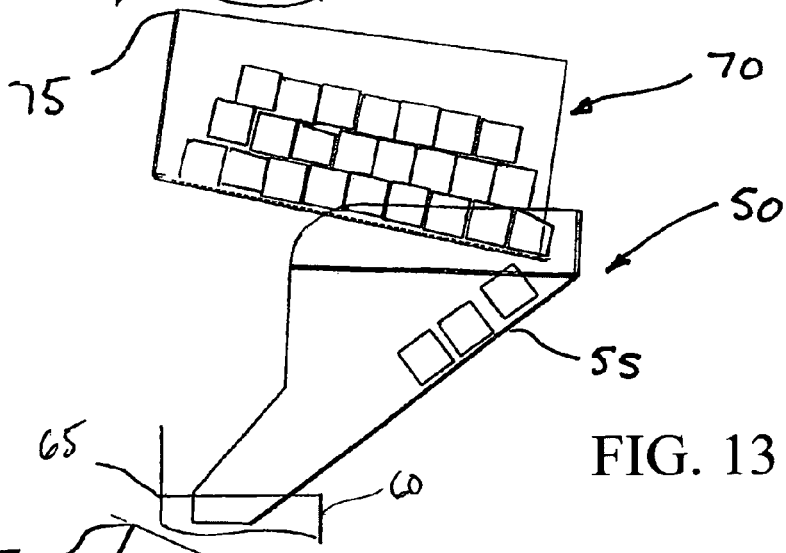
FIG. 13 is a side view of the portion of the bucket assembly shown in FIG. 11 in a partially unloaded position.
Figure 14:
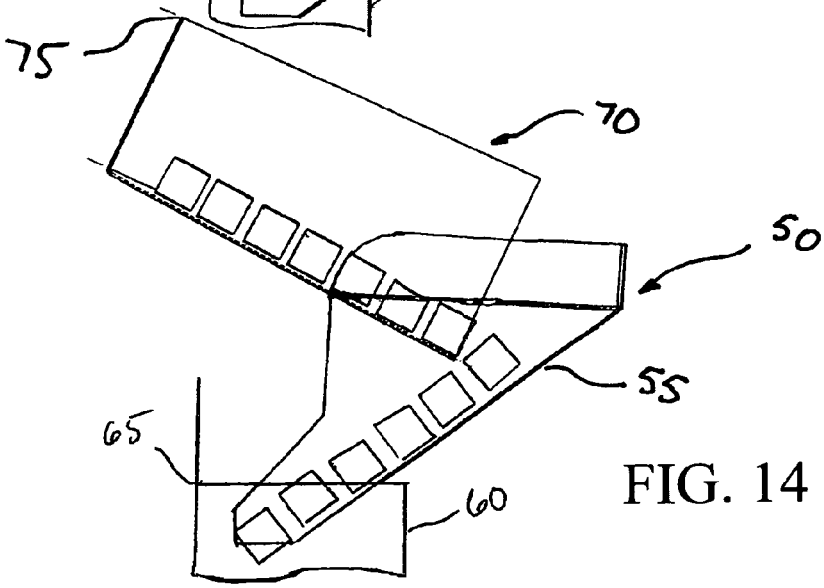
FIG. 14 is a side view of the portion of the bucket assembly shown in FIG. 11 in a fully unloaded position.

As shown step-by-step in FIGS. 12-14, gate 70 opens away from scoreline and toward an angled sidewall 55 of funnel 50 so that product streams out of gate 70 and along sidewall 55, thereby creating a generally constant and organized stream of product into carton 60. Specifically, FIGS. 13 and 14 show a stream of product transitioning in an orderly and efficient manner from gate 70 through funnel 50 and into carton 60.

According to one preferred embodiment of this invention, a portion of funnel 50 may be lowered into the opening of carton 60 prior to opening gate 70, such as shown in FIGS. 13 and 14. Such operation further ensures that product is transferred into carton 60 and will not spill out over the sides of carton 60 thereby disrupting further operation of vertical cartoner 10.

As described above, a speed of opening of gate 70 may be modulated depending upon the product to be transferred into carton 60. As such, a free flowing product, such as smooth, symmetrical, granular products may be quickly dumped from gate 70 across funnel 50 and into carton 60. On the contrary, irregular and oddly shaped products with a tendency to jaw or clog, may require a slower opening of gate 70 to ensure full and complete transfer of product from bucket assembly 20 to carton 60. Opening of gate 70 may be dampened with mechanical dampeners or may be otherwise controlled through cams, servos and/or other methods of controlling speed of gate 70 known to those having ordinary skill in the art.

According to one preferred embodiment of this invention, for product that tends to jam or clog within funnel 50, vertical cartoner 10 may be configured to stagger the opening of each gate 70 of the plurality of bucket assemblies 20 in product chain 15 across a timed cycle. As shown in FIG. 2, bucket assemblies 20 may begin the opening cycle of gate 70 at one end of product chain 15 and completely open gate 70 at opposite end of product chain 15. Such operation improves the speed of vertical cartoner 10 and avoids delays in packaging that may be caused by requiring a dwell time of funnel 50 over carton 60 during opening cycle.

Vertical cartoner 10 as described herein may include synchronized components and/or line shafting that is executed either mechanically, electronically or a combination of both using gears, belts, servomechanism and other similar components known to those having ordinary skill in the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A method of loading product into a carton having a score line between a machine-side flap and a vertically aligned opening and a generally vertical carton sidewall, the method comprising:

providing a bucket assembly having a gate and a lower portion forming a funnel having a funnel sidewall at an angle relative to a vertical, wherein the gate is connected to the bucket assembly by a hinge;

loading the product into the bucket assembly;

conveying the gate and the funnel on a product chain in a machine direction;

conveying the carton on a carton chain in the machine direction in a synchronized manner with the product chain;

positioning the funnel sidewall relative to the vertical carton sidewall;

lowering a portion of the funnel into the carton with a cam;

opening the gate away from the score line of the carton;

vibrating the funnel with a first shaker to urge the product into the carton;

vibrating the carton with a second shaker to urge the product into the carton; and streaming the product across the gate and along the funnel sidewall into the vertically aligned opening of the carton.

2. The method of claim 1 further comprising the step of:

controlling a speed of opening the gate.

3. The method of claim 1 further comprising the step of:

dampening the opening of the gate.

4. The method of claim 1 further comprising the step of:

loading a plurality of bucket assemblies; and positioning each bucket assembly of the plurality of bucket assemblies over a corresponding carton.

5. The method of claim 4 further comprising the step of:

staggering the opening of each gate of the plurality of bucket assemblies across a timed cycle.

6. The method of claim 1 further comprising the step of:

loading the product into the bucket assembly at two loading stations.

* * * * *